United States Patent [19]

Overman et al.

[11] 4,384,462

[45] May 24, 1983

[54] MULTIPLE COMPRESSOR REFRIGERATION SYSTEM AND CONTROLLER THEREOF

[75] Inventors: Joseph Overman, San Antonio; Dean Calton, La Vernia, both of Tex.

[73] Assignee: Friedrich Air Conditioning & Refrigeration Co., San Antonio, Tex.

[21] Appl. No.: 208,778

[22] Filed: Nov. 20, 1980

[51] Int. Cl.[3] ..... F25B 7/00

[52] U.S. Cl. ..... 62/175; 62/228; 236/1 EA

[58] Field of Search ..... 62/175, 196 A, 228 C, 62/228 D, 510, 157; 236/1 E, 1 EA; 165/26; 417/4, 5, 7, 8, 12, 290, 287

[56] References Cited

U.S. PATENT DOCUMENTS

| | | | |
|---|---|---|---|
| 2,274,336 | 2/1942 | Lammers, Jr. | 62/510 X |
| 2,461,760 | 2/1949 | Newton | 62/157 X |
| 3,294,023 | 12/1966 | Martin-Vegue, Jr. et al. | 417/7 |
| 3,744,932 | 7/1973 | Prevett | 417/8 |
| 3,775,995 | 12/1973 | Conley et al. | 62/196 A |
| 3,885,938 | 5/1975 | Ordonez | 62/196 A |
| 4,081,691 | 3/1978 | Evalds et al. | 307/41 |
| 4,152,902 | 5/1979 | Lush | 62/157 |
| 4,184,341 | 1/1980 | Friedman | 62/175 |

*Primary Examiner*—Albert J. Makay
*Assistant Examiner*—Harry Tanner
*Attorney, Agent, or Firm*—Gunn, Lee & Jackson

[57] ABSTRACT

A multiple-compressor refrigeration system for use in commercial refrigeration applications includes a plurality of compressors of unequal refrigeration capacity connected in a refrigeration circuit that includes a condenser and a plurality of associated evaporators and expansion devices in remotely located refrigerated enclosures. A system controller is connected to a pressure responsive transducer that measures the suction pressure of the system and compares the so-measured suction pressure to a desired suction pressure and selects one of a plurality of $2^n$ available compressor operating states in accordance with the measured difference. The system advantageously increases overall system efficiency by providing increments or decrements of compressor capacity that are more precisely matched to system load changes as compared to prior multiple-compressor systems.

20 Claims, 9 Drawing Figures

| CAPACITY STATE | 0 % CAP | A | B | C | HP |
|---|---|---|---|---|---|
| 0 | ZERO | 0 | 0 | 0 | ZERO |
| 1 | 14.2 | 0 | 0 | 1 | 5 |
| 2 | 28.5 | 0 | 1 | 0 | 10 |
| 3 | 42.8 | 0 | 1 | 1 | 5+10 |
| 4 | 57.1 | 1 | 0 | 0 | 20 |
| 5 | 71.4 | 1 | 0 | 1 | 20+5 |
| 6 | 85.7 | 1 | 1 | 0 | 20+10 |
| 7 | 100 | 1 | 1 | 1 | 20+10+5 |

3.1 3.2 3.3 3.4

Ko=0
300
P<CO(L)
NO
YES
Ko=Ko+1
NO
Ko>MKo
YES
L=0
310
NO
P<CO(L)
YES
L=L-1
L≥ML
NO
YES
312
NC'=NC-L
NC'≥LNC
NO
YES
NC'=LNCH
314
NO
UNIT IN HOT GAS DEFROST
YES
NC'≥LNCH
NO
YES
NC'=LNCH
316
L=0
Kd=0
318
NO
P<CO(L)
YES
NC' COMP COMBIN AV
NO
Kd=Kd+1
YES
320
Kd>MKd
YES
NO
NC=NC'
ENABLE CAP (NC)
322

MULTIPLE COMPRESSOR REFRIGERATION SYSTEM AND CONTROLLER THEREOF

BACKGROUND OF THE INVENTION

The present invention relates to multiple-compressor refrigeration systems and, more particularly, to multiple compressor refrigeration systems in which one or more of the compressors are selectively operated in response to varying system load requirements.

Large-scale commercial refrigeration systems such as those employed in supermarkets typically employ a plurality of compressors in a refrigeration circuit to compress the system working fluid. The refrigeration circuit includes a system condensor which receives the compressed working fluid from the compressor and a plurality of remotely located refrigerated cases or enclosures which receive the condensed working fluid from the system condenser and pass it through an expansion valve or other expansion device and an evaporator within the refrigerated enclosure to chill the space within the enclosure. Typically, the display enclosures include meat cases, beverage coolers, frozen food cases, ice chests, and the like. After the working fluid is passed through the evaporator, the expanded refrigerant is than returned to the compressors through a return or suction line where the cycle is repeated. As is well known in the art, the refrigeration load requirements for these systems can vary greatly depending upon the ambient temperature, the quantity of merchandise in the refrigerated enclosures, the loading of additional room-temperature merchandise into the enclosures, and the removal of chilled merchandise from the enclosures. Because of the widely varying load requirements, most large-scale refrigeration systems utilize a plurality of compressors with one or more of the compressors operated in response to system load requirements. For example, during light load periods, only one of the available compressors may be in operation; conversely, during heavy load periods, all the compressors may be in operation.

In most multiple-compressor systems, the compressors are controlled in response to system return line or suction pressure. In some systems, the individual compressors are provided with a pressure-responsive transducer at the suction inlet. Typically, the pressure controllers for the various compressors are set at successively higher cut-in pressures so that as the suction pressure rises, successive compressors will cycle on to cause the desired increase in compressor capacity and a consequent reduction in suction pressure to a preferred limit. As the suction pressure drops in response to additional compressor capacity coming on line, the last-on compressor is cycled by its transducer to the off state. Other refrigeration systems use a single pressure responsive sequencer which provides multi-stage control of the various compressors. This type of controller is typically connected to the suction side manifold and is electrically connected to each compressor in the system. The multi-stage sequencer automatically cycles on additional compressors in response to increases in suction line pressure and cycles the compressors off as suction line pressure diminishes.

Both types of mechanical controllers generally provide adequate suction line pressure control, although there are several drawbacks to these controllers from a commercial standpoint. In refrigeration systems, it is generally desirable to maintain the suction side pressure within a relatively narrow bandwidth to thereby maintain the evaporator temperature in a directly related temperature bandwidth. Mechanically responsive pressure controllers, by virtue of their mechanical structure, generally can not provide a cut-in/cut-out pressure difference or less than 5 psi. In those systems in which three or four compressors are utilized with each compressor set for cut-in at successively higher pressure, it is not uncommon for suction pressure to vary in a 15 psi range. In addition to this drawback, pressure responsive sensors respond to both short-term transient changes in suction pressure as well as longer term changes. Accordingly, a short-term transient increase in suction pressure can cause the starting of a disproportionally large amount of compressor capacity resulting in oscillations in the suction pressure and unnecessary compressor cycling.

Another disadvantage of the above-described mechanical systems is that the compressors are cycled solely in response to suction line pressure and, thus, are cycled even in the event that all the refrigeration cases are at their design temperature. This condition can arise, for example, when open refrigerated cases are being operated in store ambients lower than that for which the system was designed. In this case, continued control of compressor capacity in response to suction pressure can result in superfluous and inefficient compressor utilization, and in lower than desired product temperatures.

SUMMARY OF THE INVENTION

It is a primary object of the present invention, among others, to provide a multiple-compressor refrigeration system in which the compressors are cycled on and off to efficiently meet system load requirements.

It is another object of the present invention to provide a multiple-compressor system in which the compressors are cycled on and off in response to the load requirements of the system as determined by suction line pressure and the temperature of the refrigerated enclosures.

It is another object of the present invention to provide a multiple-compressor system in which changes in system load requirements over a period of time are determined and the necessary increment of decrement in system capacity is provided to meet the load change.

It is another object of the present invention to provide an improved controller for multiple-compressor refrigeration systems which control the operating cycle of the compressors in response to system load requirements.

It is still another object of the present invention to provide an improved controller for a multiple-compressor refrigeration system which efficiently cycles the compressors on and off in response to suction pressure and refrigerated enclosure temperature.

It is still another object of the present invention to provide a controller for a multiple-compressor refrigeration system in which the magnitude of the increase or decreases in system load is determined and appropriate increments or decrements of compressor capacity are provided to meet the changes in the system load.

It is still another object of the present invention to provide a method of operating a multiple-compressor refrigeration system in which the magnitude of increases or decreases in system load are determined and increments or decrements of compressor capacity are provided to meet the so-determined change in load requirements.

In accordance with these objects and others, the present invention provides an n compressor refrigeration system in which at least one of the compressors has a different compressor capacity than the others to permit $2^n$ or $2^n-1$ compressor operating states. The compressors provide a compressed working fluid to a system condenser which then provides the condensed working fluid to a plurality of remotely located expansion devices and associated evaporators located in refrigerated enclosures or spaces with the expanded working fluid being then returned to the compressors through a suction line. A pressure-responsive transducer is connected to and measures the pressure in the suction line and provides an output signal to a compressor controller that is capable of operating the compressors in various permutations to provide as many as $2^n$ levels of compressor operating capacity. The controller determines the increment or decrement of compressor capacity to meet the load requirement changes of the system and then selects one of the $2^n$ available operating states to meet the so-determined change in system load. In one aspect of the invention, at least one and preferably all of the evaporators are provided with temperature responsive sensor(s) that determine when the temperature of the refrigerated enclosure or space is below the desired upper limit and inhibits the controller to prevent unnecessary increases in compressor capacity when the refrigerated enclosures or spaces are all at or below the intended upper temperature limit. The controller may take the form of a microprocessor-based controller or a solid-state hardwired, discrete component controller.

The invention advantageously provides multiple levels of compressor control and permits more precise matching of compressor capacity to system load.

BRIEF DESCRIPTION OF THE DRAWINGS

The above description, as well as the objects, features, and advantages of the present invention will be more fully appreciated by reference to the following detailed description of a presently preferred but nonetheless illustrative embodiment in accordance with the present invention when taken in conjunction with the accompanying drawings wherein:

FIG. 6 is a legend indicating the manner by which FIGS. 5A and 5B are to be read;

DESCRIPTION OF THE PREFERRED EMBODIMENT

Figure 1:
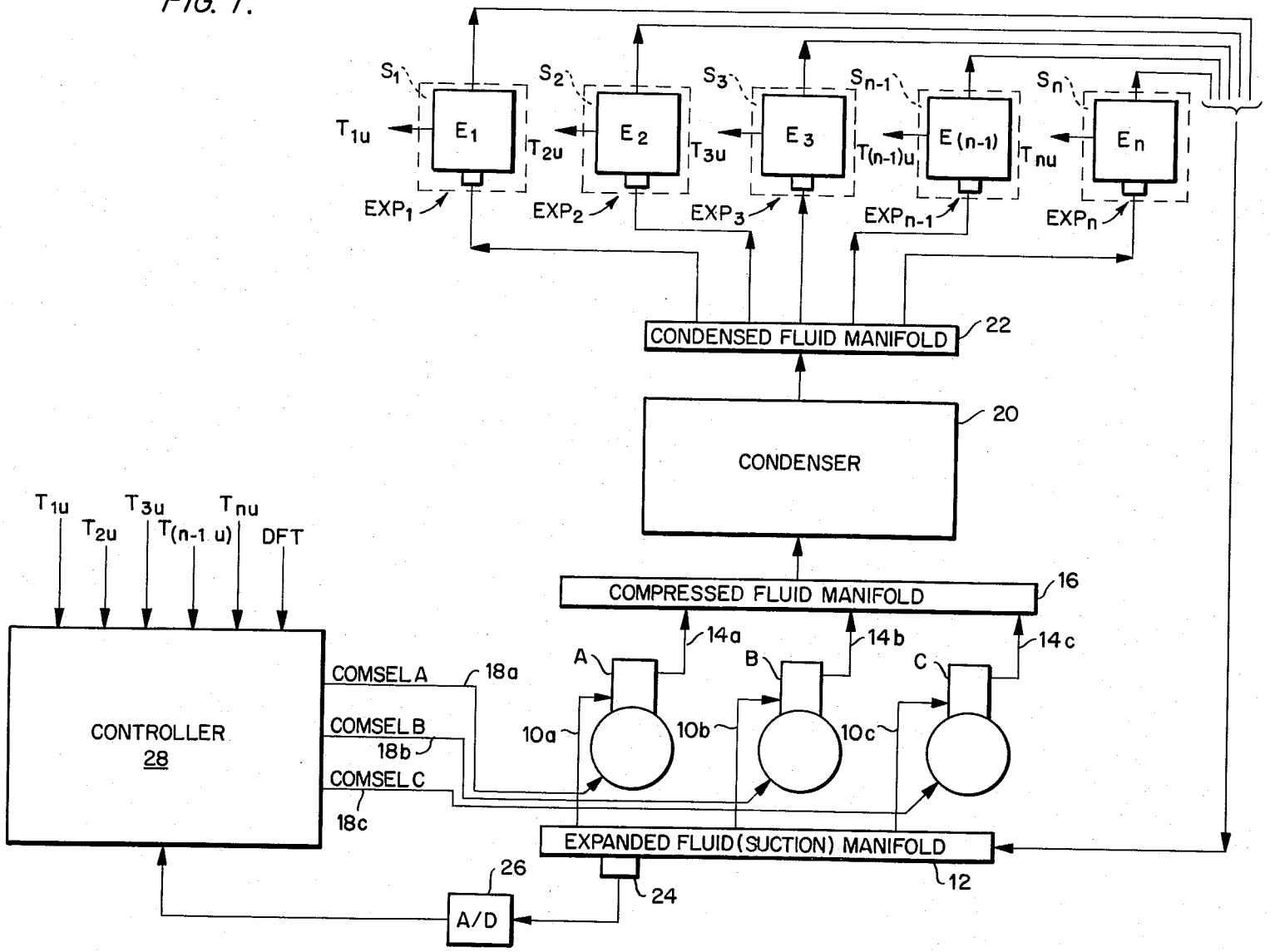
FIG. 1 is an overall system view, in schematic form, of a multiple-compressor system in accordance with the present invention.

A preferred embodiment of a refrigeration system in accordance with the present invention is shown schematically in FIG. 1 and includes a plurality of conventional motor-driven refrigeration compressors A, B, and C that have an inlet or suction side lines 10A, 10B, and 10C, respectively, connected to an inlet or suction side manifold 12 and outlet lines 14A, 14B, and 14C connected to a compressed fluid manifold 16. Each of the compressors A, B, and C, is connected to a control signal line 18A, 18B, and 18C, respectively, for controlling the ON/OFF operation of the compressor motors (not specifically shown) that drive each compressor A, B, and C.

The compressors A, B, and C operate in a conventional manner to draw relatively low-pressure expanded refrigerant working fluid (such as refrigerant 502) from the suction manifold 12 and deliver the compressed fluid at relatively high pressure to the compressed fluid manifold 16. At least one and preferably all of the compressors A, B, and C have unequal compressor capacity to provide a plurality of different operating states. For example, in the preferred embodiment, the compressor A is a 20 horsepower (HP) compressor, the compressor B is a 10 HP compressor, and the compressor C is a 5 HP compressor. As can be appreciated, compressor A provides approximately 57% of full system capacity, compressor B provides approximately 28.5% of full system capacity, and compressor C provides approximately 14% of full system capacity. As explained more fully below, the compressors A, B, and C can be operated in various combinations or permutations to provide $2^3$ operating states (that is, eight states) to permit the refrigeration system to precisely respond to system load requirements.

The compressed fluid manifold 16 is connected to a system condenser 20 which condenses the compressed fluid provided by the compressors A, B, and/or C and delivers the so-condensed working fluid to a condensed fluid manifold 22. A plurality of fluid carrying lines deliver the condensed refrigerant working fluid to various remotely located refrigerated spaces $S_1$, $S_2$, $S_3$, . . . $S_{(n-1)}$, $S_n$ (broken line illustration). The refrigerated spaces $S_n$, for example, in the commercial supermarket application, may make take the form of meat cases, beverage coolers, frozen food cases, ice chests, and the like. The refrigerated spaces $S_n$ each include an expansion valve $EXP_1$ . . . $EXP_n$ or equivalent device and associated evaporator $E_1$ . . . $E_n$. The expansion valve $EXP_n$ operates in the conventional manner to expand the condensed refrigerant delivered from the manifold 22 with the associated evaporator $E_n$ absorbing heat energy from the respective refrigerated enclosure or space to effect the desired refrigeration. The expanded working fluid is then returned to the suction manifold 12 through appropriate lines to repeat the refrigeration cycle.

At least one, and preferably all, the refrigerated spaces $S_1$ . . . $S_n$ include a temperature responsive device (not specifically shown), such as a thermostat or thermistor probe which is adapted to measure the temperature in the refrigerated space or enclosure and provide a temperature signal $T_{1u} \ldots T_{nu}$ that indicates when the temperature of the refrigerated space is above a predetermined limit, for example, above −20° F. in the case of a frozen food case, above 0° F. in the case of an ice chest, and above 35° F. in the case of a refrigerated meat or beverage case; it being noted that the temperatures enumerated above are merely exemplary and not limiting.

A pressure-responsive transducer 24 is connected to the manifold 12 and is adapted to measure the inlet or suction pressure of the expanded working fluid being delivered to the inlet of the compressors A, B, and C. The transducer 24, which is preferably of a conventional analog type, is connected to an analog/digital (A/D) convertor 26 which converts the analog output of the transducer 24 to a digital output (either serial or parallel).

A system controller 28 is provided to effect coordinated control of the system. The controller 28, which may take the form of a microprocessor-based controller as described in connection with FIG. 7 or a hardwired discrete component controller as described in connection with FIG. 8, includes three control output lines that provide compressor selection 'COMSEL' signals along the lines 18A, 18B, and 18C to, respectively the compressors A, B, and C. The compressor select signals 'COMSEL' are adapted to turn the compressors A, B, and C on or off as described more fully below. The controller 28 receives, as its control inputs, the digital pressure information from the analog to digital convertor 26, the upper temperature limit information $T_{1u} \ldots T_{nu}$ from the various refrigerated spaces $S_1 \ldots S_n$ and a hot gas defrost signal 'DFT.'

While not specifically shown but as is well known in the art, the system of FIG. 1 is adapted to provide a hot gas defrost cycle for one or more of the various evaporators $E_1 \ldots E_n$. This is accomplished by providing a normally open valve in the outlet line of each evaporator, or group of similar evaporators, a refrigerant conduit from the outlet of the evaporator to the compressed fluid manifold 16, and a normally closed valve in that conduit. When it is desired to defrost a particular evaporator, either in response to a predetermined defrost cycle or in response to a specific build-up of ice or frost on the evaporator, the normally open valve in the outlet line of the evaporator is closed to isolate the outlet of the evaporator and the normally closed vlave in the aforementioned conduit is opened to direct hot pressurized working fluid through the selected evaporator to remove the accumulated frost. After the defrost is completed, the normally closed valve is once again closed and the normally opened valve is once again opened to place the system in its original refrigeration configuration. When any one of the evaporators is in such a hot gas defrost cycle, however, a hot gas defrost signal 'DFT' is provided to the controller 28.

Figures 2, 3:
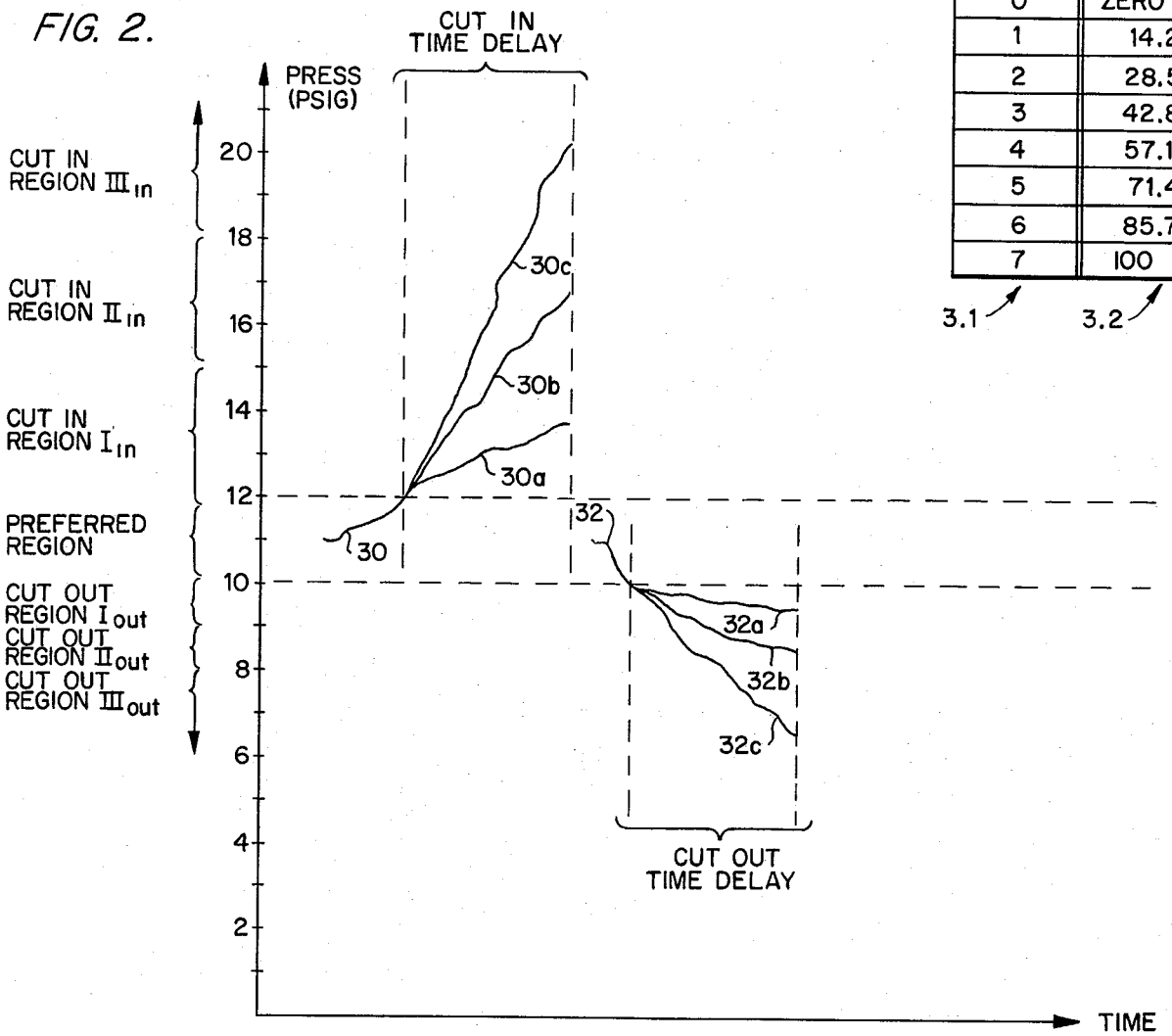
FIG. 2 is a graphical representation, in idealized form, of system suction pressure vs. time for the system shown in FIG. 1 in which the ordinate represents suction pressure in psig and the abscissa represents time.
FIG. 3 is a table setting forth the compressor operating states available for the three compressor systems shown in FIG. 1 including the percentage capacity, the compressors in operation, and the horsepower (HP) of each operating state.

In refrigeration systems of the type described above, the design evaporator operating temperature is a function of the suction pressure of the refrigerant on the inlet or suction side of the compressors. In general, it is desirable to maintain the suction pressure within predetermined limits to minimize variations in suction pressure, and, consequently, minimize variation in evaporator operating temperature. FIG. 2 represents an idealized suction pressure (PSIG) vs. time chart for a refrigeration system of the type shown in FIG. 1 in which 12 psig has been set as the suction pressure upper limit and 10 psig has been set as the suction pressure lower limit, this pressure range establishing a −25° F. minimum operating temperature for a 502 type refrigerant. Under the usual systems design criteria, all the refrigerated spaces or enclosures $S_1 \ldots S_n$ will be at temperature when the suction pressure is within the 10–12 psig bandwidth. Should the refrigeration load requirements of the system increase, for example, by opening a refrigerated enclosure and loading it with room-temperature merchandise, the change in the system load requirement will be manifested by an increase in suction pressure above the upper limit (12 psig) of the preferred range with the rate of rise and the magnitude thereof depending upon the increase in load (e.g. plot 30 in FIG. 2). Conversely, should the system load requirement diminish (that is, as a consequence of the compressors providing more compressor capacity to the refrigeration system than the load requires) the suction pressure will drop below the lower limit (e.g., plot 32 in FIG. 2).

In conventional refrigeration systems utilizing multiple pressure-responsive controllers or a single multistage controller, successive compressors will be turned on as the suction pressure increases. Because of the sensitivity limitations of mechanical devices, large increments of compressor capacity can be brought on line in response to small transient changes in the system load requirements to thereby cause unnecessary compressor cycling and consequent oscillations in system suction pressure. In the inventive system, by contrast, additional compressor capacity is provided to the system precisely in response to the increased load requirements to minimize those occasions when more compressor capacity is provided than is actually required to meet the new load requirement.

As described above, the compressors A, B, and C have unequal compressor capacity such as, respectively, 20, 10, and 5 HP. As shown in FIG. 3, $2^3$ or eight operating states or levels, are available depending upon which compressors are operating. As a practical matter, however, the zero state, in which none of the compressors are operating, is usually not employed since it is advisable from a practical standpoint to maintain at least one compressor running at all times. Accordingly, using the three compressors described, there are $2^n-1$ or seven preferred operating states available. In FIG. 3, the column identified by the reference character 3.1 represents the eight possible operating states from operating state zero to operating state seven; the column identified by the reference character 3.2 represents the approximate percentage of total compressor capacity for that state; the columns identified by the reference character 3.3 indicate whether or not a particular compressor is in operation with the number zero indicating the off state and number 1 indicating an on state; and the column 3.4 represents the compressor capacity in Hp. at each level.

In accordance with the present invention and as illustrated in FIG. 2, the suction pressure parameter (ordinate) has been divided into a preferred operating region between the aforedescribed 10 and 12 psig limits; three cut-in regions above the preferred region in which additional increments of compressor capacity are provided including a first region, region $I_{in}$, between 12 and 15 psig having a cut-in threshold pressure of 12 psig; a second region, region $II_{in}$ between 15 psig and 18 psig having a cut-in threshold pressure of 15 psig; and a third region, region $III_{in}$, extending above 18 psig and having a cut-in threshold pressure of 18 psig. In addition, three cut-out regions are defined below the preferred suction pressure region including a first cut-out region, region $I_{out}$, between 9 and 10 psig with a cut-out threshold of 10 psig; a second cut-out region, region $II_{out}$ between 8 and 9 psig with a cut-out threshold of 9 psig; and a third cut-out region, region $III_{out}$, extending below 8 psig and having a 8 psig cut-out threshold pressure.

In accordance with the inventive concept, once suction pressure, as illustrated by the curve 30 in FIG. 3, rises above the preferred region upper limit of 12 psig to region $I_{in}$, the controller 28 after a suitable timing period is operative to increase compressor capacity by one level; thus, if the compressors are operating at a capacity level of 1 (14.2%), when the suction pressure increases to region $I_{in}$, the controller 28 (in a manner to be described below) will increase the compressor capacity to level 2 (28.5%). As shown in column 3.3, this increase from the first level to a second level is accomplished by turning off the compressor C and turning on the compressor B. If during the timing period the suction pressure should rise into region $II_{in}$ by increasing beyond the 15 psig cut-in threshold for region $II_{in}$, as illustrated by the curve **30*b* in FIG. 3, the controller 28 increases the compressor capacity two levels from the aforedescribed level 1 (14.2%) to level 3 (42.8%) by changing the compressor operating state as shown in columns 3.3 by turning on the compressor B. If during the timing period, the suction pressure should rise and enter region $II_{in}$ by increasing beyond the 18 psig cut-in for region $III_{in}$, as illustrated by the curve 30*c* in FIG. 3 the controller 28 increases the compressor capacity three levels from level 1 (14.2%) to level 4** (57.1%) by turning off the compressor C and turning on the compressor A. As can be appreciated from the above, compressor capacity is incremented in accordance with the increased load requirement by turning selected ones of the compressors on and off.

In a similar, though inverse manner, the compressor capacity is decremented as the suction pressure passes below the preferred region lower limit of 10 psig into the first cut-out region, region $I_{out}$. In this case, the controller 28 after a suitable timing period reduces the compressor capacity by one level; thus, if the compressor capacity is at level 7 (100%) and the suction pressure enters the first cut-out region, as illustrated by the curve **32*a* in FIG. 3 the compressor capacity will be reduced to level 6 (85.7%) by turning off compressor C. Should the suction pressure, during the timing period, continue to drop and enter the second cut-out region, region $II_{out}$, by dropping below the 9 psig threshold, as illustrated by the curve 32*b* in FIG. 3 the controller 28 will respond by reducing compressor capacity by two levels from level 7 (100%) to level 5 (71.4%) by turning off compressor B. Likewise, should the suction pressure, during the timing period, enter region $III_{out}$ by dropping below the 8 psig cut-out threshold, as illustrated by the curve 32*c* in FIG. 3, the controller 28 will reduce the compressor capacity by three levels from the previous compressor capacity level 7 (100%) to level 4** (57.1%).

As can be readily appreciated from the above examples of the incrementing and decrementing of compressor capacities, changes are made in relatively precise increments in response to the rate of change in suction pressure. This is to be contrasted to prior art systems, where additional large increments of compressor capacity can be provided in response to the small and transient changes in suction pressure. For example, if the compressors A, B, and C of FIG. 1 were equipped with standard mechanical pressure controllers for regions $I_{in}$, $II_{in}$, $III_{in}$only three operating states would be available, that is, compressor A on (57.1% capacity); compressors A and B on (85.7% capacity); and compressors A, B, and C on (100%).

Figure 7:
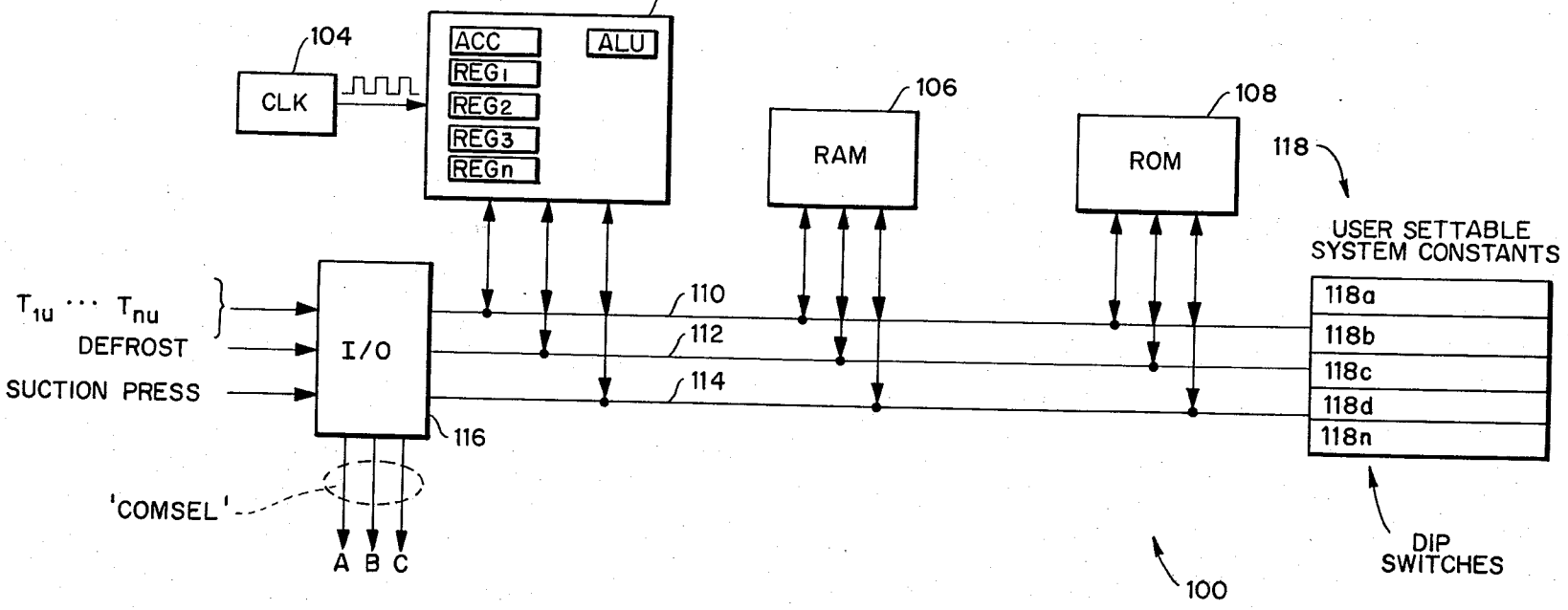
FIG. 7 is a schematic block diagram of a first type of controller for effecting control of the system shown in FIG. 1.

The controller 28 may be implemented either through a microprocessor-based controller or a hard-wired, discrete device controller. An exemplary microprocessor-based controller 100 is shown in FIG. 7 and, as shown therein, includes a central processor 102 driven by an appropriate clock 104. The central processing unit 102 includes the usual registers such as an arithmetic logic unit (ALU) for performing various arithmetic and logic operations, an accumulator (ACC), and a plurality of registers ($REG_1 \ldots REG_n$) for manipulating information within the microprocessor 102. A random access memory (RAM) 106 and a read only memory (ROM) 108 are provided. With these memories and the microprocessor 102 interconnected through control, data, and address busses 110, 112, and 114, respectively. The random access memory 106 is used as a temporary store for system data while the read only memory 108 includes permanently encoded instructions for operating the central processor 102 with the instructions including the various compressor operating states. An input/output interface 116 is connected to the various busses described above and receives as its inputs, the temperature upper limit information $T_{1u} \ldots T_{nu}$, the suction pressure information in digital form from the A/D convertor 26 (FIG. 1), and the defrost information; and provides the compressor select "COMSEL" signals for incrementing or decrementing the compressor capacity level. A user settable switch register 118 is connected to the busses described above and consists of multiple-position DIP switch sub-registers $118_a \ldots 118_n$ for permitting the system operator to manually enter system constants including the thresholds for the various suction pressure regions, and other information necessary to operate the system. In the preferred form, the central processor 102 is a 6512 microprocessor and associated support integrated circuits (IC) manufactured by the MOS Technology Corporation cooperating with an NBC-010-65 control board manufactured by the Synertek Corporation.

Figure 4:
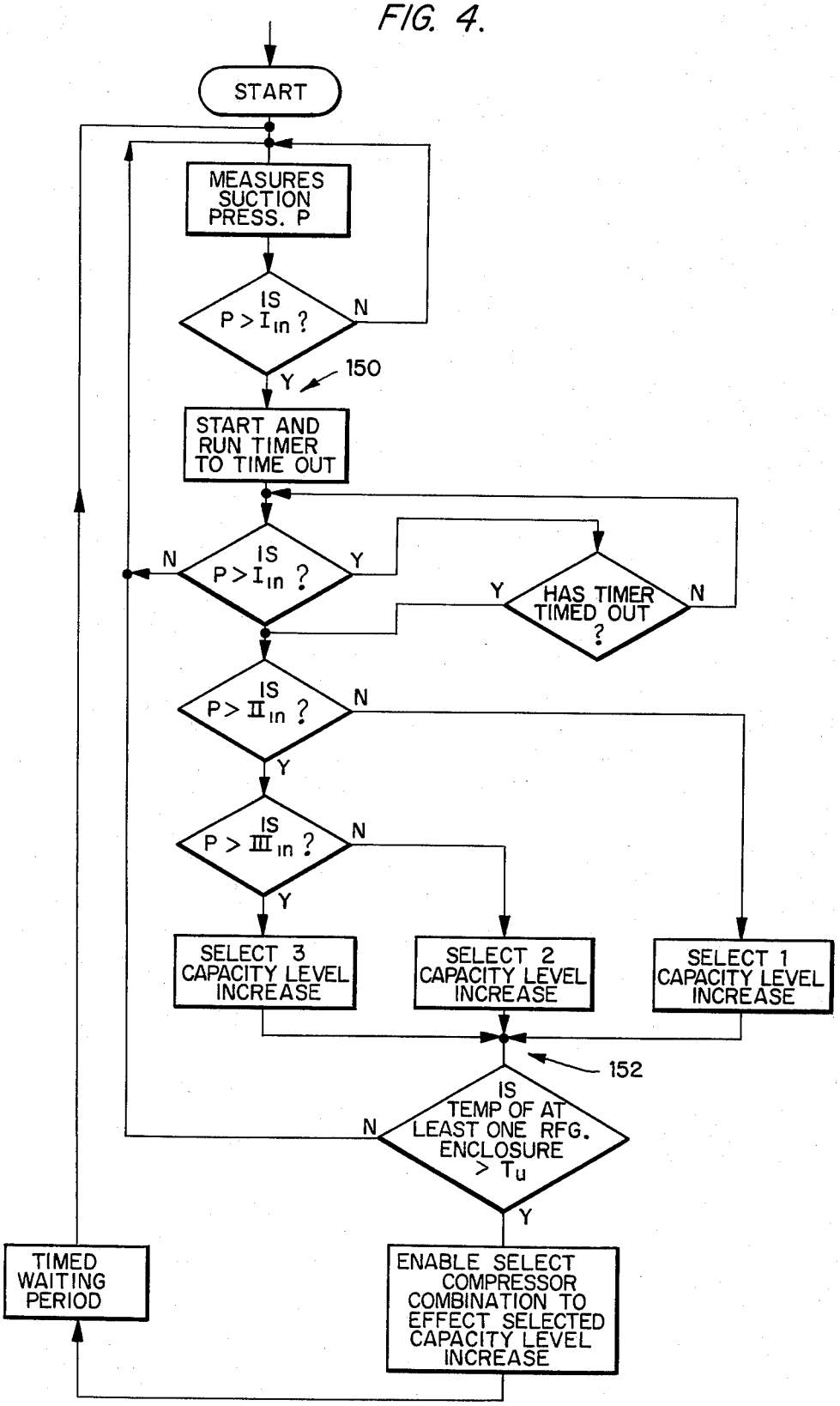
FIG. 4 is a simplified flow diagram which summarizes, in an exemplary manner, the operation of the system shown in FIG. 1 for incrementing compressor capacity.
Figures 5A, 5B:
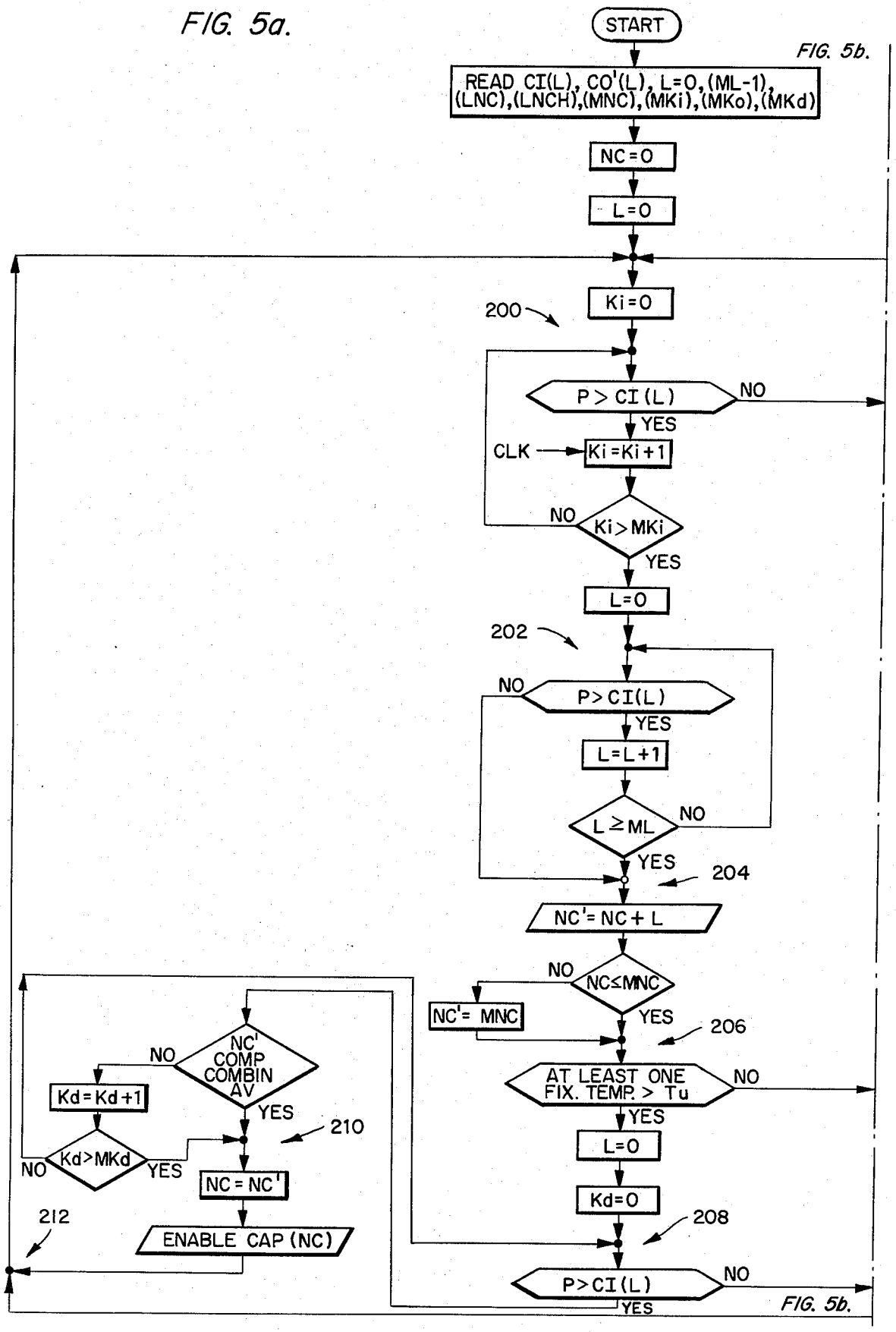
FIGS. 5A and 5B represent a detailed flow diagram describing the operating states of the system of FIG. 1.
Figures 5A, 5B, 6:
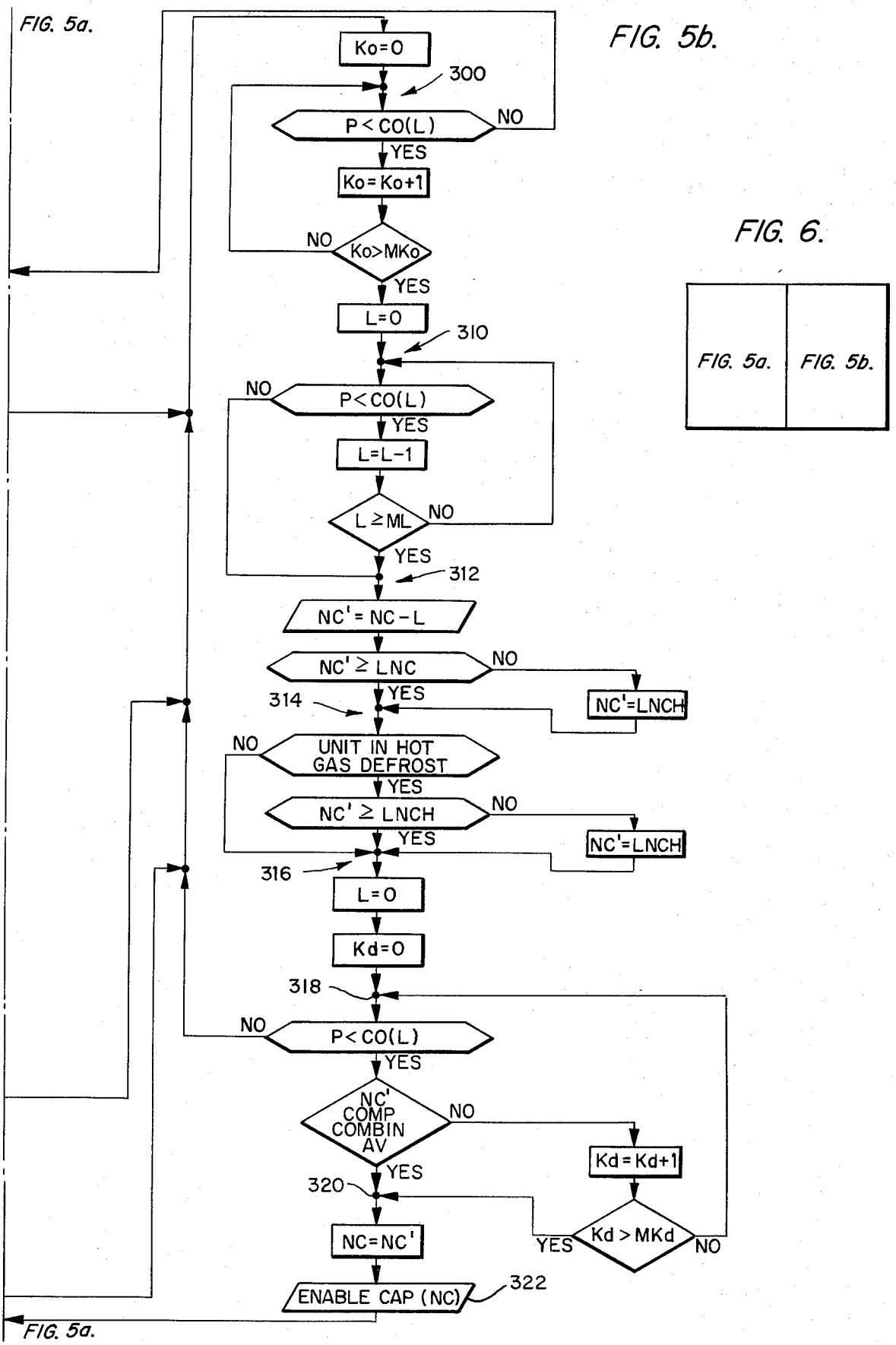

A flow diagram which summarizes the manner in which the microprocessor-based controller 100 of FIG. 7 operates for incrementing compressor capacity levels is shown in FIG. 4 while a more detailed diagram for an actual embodiment for both incrementing and decrementing compressor capacity is shown in FIGS. 5A and 5B as read in accordance with FIG. 6.

As shown in FIG. 4, after start-up, the suction pressure P is measured and tested to determine if it is greater than the cut-in pressure for the first region; if the pressure P is less than the cut-in pressure (indicating that the suction pressure P is within the preferred range), the suction pressure P is again monitored by the testing sequence on a cyclic basis. If the suction pressure P is greater than the cut-in pressure for the first region, region $I_{in}$ (point 150, FIG. 4), a preset timer is allowed to begin timing and the suction pressure P again measured to see if it is still within the first region cut-in pressure; if the suction pressure P is less than the cut-in pressure (indicating that the change in suction pressure was merely a relatively short-term transient) the monitoring test sequence is resumed. If the suction pressure P, however, remains above the region $I_{in}$ threshold, at the end of the timing period the pressure is successively measured to determine the actual region, and the capacity level increase or increment is selected. After the capacity level is selected (node 152), a determination is made if any one of the refrigerated spaces $S_1 \ldots S_n$ is operating at a temperature greater than its respective upper limit $T_{1n} \ldots T_{nu}$, and, if so, the selected compressors are enabled.

A more detailed flow diagram for a preferred embodiment is shown in FIGS. 5A and 5B with FIG. 5A generally illustrating the process steps necessary to effect incrementing of the compressor capacity and FIG. 5B generally illustrating the steps necessary to effect decrementing of compressor capacity. In FIGS. 5A and 5B, the various mnemonics illustrated are defined as in the following table:

TABLE I

| | | |
|---|---|---|
| CI | = | Cut In Pressure (Capacity increase indicated) |
| CO | = | Cut Out Pressure (Capacity decrease indicated) |
| L | = | Level/Level Change |
| ML | = | Level/Level Change - Maximum Permitted in Single Step |
| NC | = | System Capacity Level - Operating |
| NC' | = | System Capacity Level - Select |
| LNC | = | System Capacity Level - Lowest |
| LNCH | = | System Capacity Level - Lowest with Hot Gas Defrost |
| MNC | = | System Capacity Level - Maximum |
| P | = | System Operating Suction Pressure |
| $K_i$ | = | Cut in Time Count (Seconds) |
| $MK_i$ | = | Cut in Time Count Maximum (Seconds) |
| $K_o$ | = | Cut Out Time Count Seconds |
| $MK_o$ | = | Cut Out Time Count Maximum (Seconds) |
| $K_d$ | = | Availability Time Count (Seconds) |
| $MK_d$ | = | Availability Time Count Maximum (Seconds) |

After start-up, the various user settable registers including the cut-in (CI) and cut-out (CO) pressures for the various levels (L), the maximum number of levels defined (ML), the lowest level available, the hot gas defrost register (LNCH), and the various cut-in/cut-out time delay registers ($MK_i$; $MK_o$; $MK_d$) are initialized.

Thereafter, the NC, L, $K_i$ registers are set to zero (node 200) and the suction pressure P for the first cut-in level CI(L) is read. If the suction pressure is greater than the cut-in pressure for the first level, the time delay register $K_i$ is incremented by 1 (second) and this monitoring process continued until the time delay register $K_i$ times-out (typically 10–30 seconds in the case of the preferred embodiment). At this point, node 202, it has been determined that suction pressure P has been greater than the threshold limit for the first region for a specified period of time ($MK_i$), that is, the out-of-limit pressure indication is not of a transitory nature. Thereafter, between nodes 202 and 204, the suction pressure P is again checked to determine that it is greater than the cut-in threshold pressure for the first region. Thereafter, the cut-in threshold is incremented for each region ($L=L+1$) until the region that the suction pressure is in is determined (node 204). Thereafter, the level change register NC' is set equal to the present capacity level (NC) plus the number of level (L) changes determined between the nodes 202 and 204. Between nodes 204 and 206, the determination is made whether or not the projected level change NC' is less than or equal to the maximum system capacity level changes MNC. Between nodes 206 and 208, the determination is made if at least one of the temperatures T of the refrigerated spaces is above its upper temperature limit $T_u$, and the suction pressure P is again checked. A determination is then made to determine that the compressors necessary to implement the level changes are available (node 210) and, if not, a timer $K_d$ is started and timed-out to again test the availability of the compressors. The need for the $K_d$ time delay arises from the need to wait at least two minutes after the last shut-down before restarting a compressor. Thus, if any compressor is not available because its two-minute-from-last-shut-down timer has not timed-out, the time delay $K_d$ will permit the processor to wait until a compressor is available. Thereafter, at node 212, the selected compressors to effect the necessary level changes are enabled. The processor 102 maintains the current compressor operating state in its registers $R_1 \ldots R_n$ and can determine the necessary increment or decrement in compressor capacity by referring to the available compressor state information in its memory 108.

The flow diagram of FIG. 5B is similar to that of FIG. 5A but relates to the control of the compressor capacity for decrementing the capacity rather than incrementing, as in the case of FIG. 5A. After initialization, as discussed above, the suction pressure P is checked after node 200 (FIG. 5A) and if the pressure P is less than the threshold for the first cut-in region $I_{in}$, the flow diagram branches to node 300 in FIG. 5B where the suction pressure P is tested to see if it is less than the first cut-out region threshold pressure, if so, a timer $K_o$ is started and timed-out ($MK_o$) to verify that suction pressure P is less than the first region cut-out limit, for the specified time. After the timer $K_o$ times out at node 310, the suction pressure P is again measured for the various levels by decrementing the level register ($L=L-1$) so that by node 312 the region in which the suction pressure lies is identified in the L register. Thereafter, the required level change register NC' is set equal to the present level minus the level change between nodes 312 and 314 ($NC'=NC-1$); a check is made to see if any of the refrigerated spaces $S_n$ are in a hot gas defrost (between nodes 314 and 316). If any of the units are in a hot gas defrost, and the level change register NC' is less than LNCH then NC' is set equal to LNCH. Thereafter, between nodes 318 and 320, the suction pressure P is again checked, and then the compressor availability checked to determine if the required compressors are available to effect decrementing of the compressor capacity.

Figure 8:
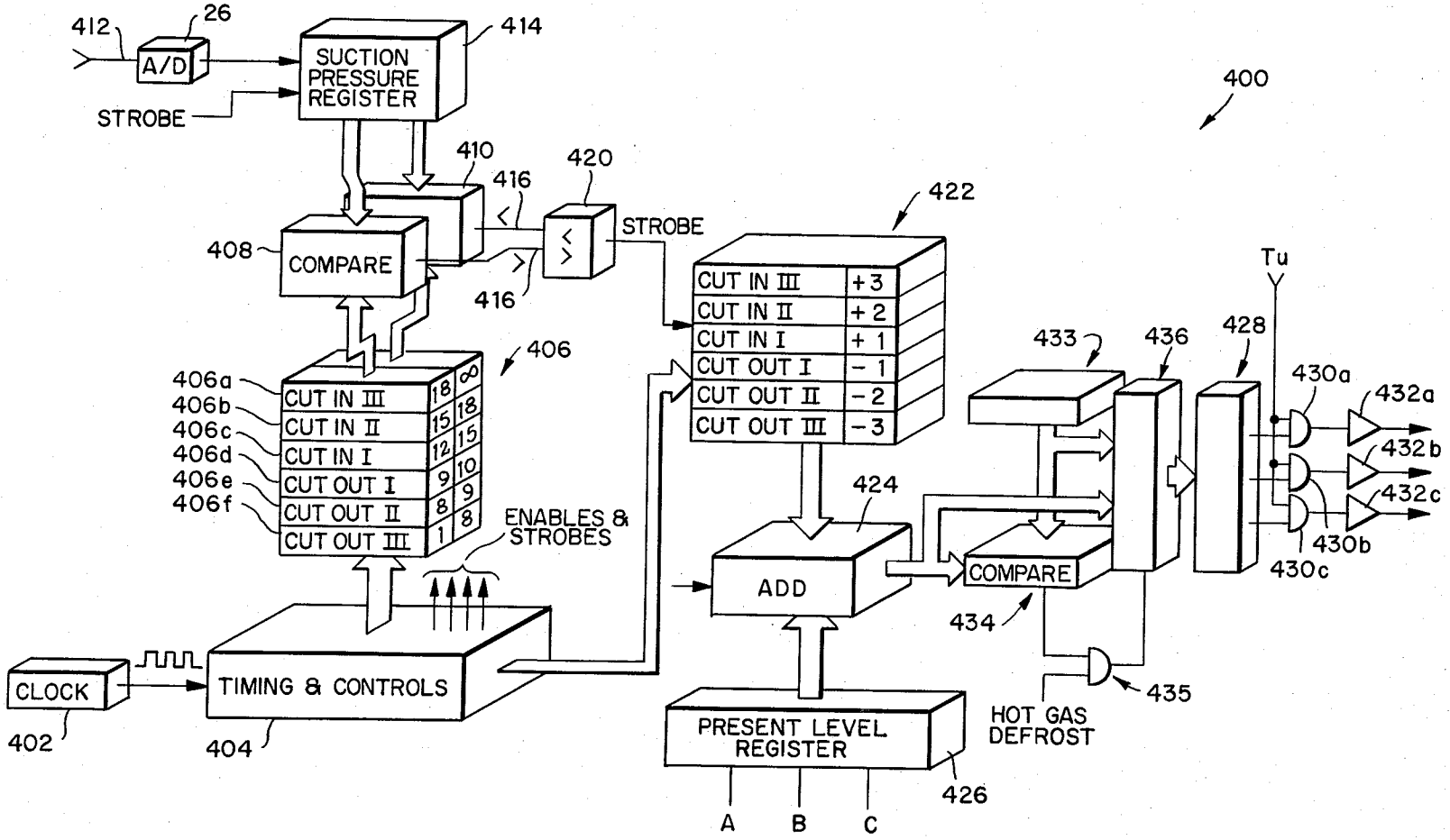
FIG. 8 is a schematic block diagram of a second type of controller for effecting control of the system shown in FIG. 1.

The controller 28 of FIG. 1 may also take the form of a discrete component, hard-wired, solid-state controller 400 shown in FIG. 8. The circuitry shown therein is of a schematic form with the various power, control, and timing interconnects within the skill of the art.

The controller 400 includes a clock 402 that provides a plurality of repeating clock pulses at a selected pulse repetition rate to a timing and control circuit 404 that counts the pulses on a cyclic basis and provides various cyclic enable, strobe, and other control signals to the remaining circuits of the controller 400 to effect overall coordinated control. The timing and control circuit 404 may take the form, for example, of a plurality of digital counters that divide the clock pulses at various rates or, more particularly, a plurality of counters in combination with a programmed logic array (PLA).

A limit-pair register 406 which includes sub-registers 406A . . . F is connected to the timing and control circuit 404 and receives cyclic enable signals therefrom. The limit-pair register 406 further takes the form of a plurality of 8-bit DIP switch registers in which the upper and lower limits for the suction pressure in each of the aforedescribed cut-in and cut-out regions are set by the user. Thus, a first limit-pair sub-register, for example, sub-register 406C includes the settings for the upper and lower limits of the first cut-in region, region $I_{in}$, (that is 12 and 14 psig), and a second limit-pair sub-register, e.g., sub-register 406B includes the upper and lower suction pressure limits for the second cut-in region region $II_{in}$ (that is, 15 and 18 psi). In a like manner, the various other suction pressure limit-pair sub-registers include the respective limit information. The timing and control circuit 404 enables, in a successive serial manner, the limit pair sub-registers 406A . . . F to successively present the limit pair information to a pair of limit comparators 408 and 410, described below. The suction pressure information from the suction pressure transducer (24, FIG. 1) is provided along line 412 to the aforedescribed analog/digital (A-D) converter 26 which provides the suction pressure information in binary form through a suction pressure register 414 that, in turn, presents the measured suction pressure information to the limit comparators 408 and 410. Each of the comparators 408 and 410 is adapted to compare the suction pressure information from the suction pressure register 414 with the serially presented limit value information presented by the limit-pair sub-registers 406A . . . F as each of the sub-registers is enabled by the timing and control circuit 404. More specifically, the comparator 408 compares one of the limits, e.g., the lower limit of each suction pressure region, and the comparator 410 compares the second of the limits, e.g., the upper pressure limit for the various suction pressure regions. The comparator 408 provides an indication along output line 416 when the suction pressure is greater than the compared limit and the comparitor 410 provides an indication along line 418 when the compared suction pressure is less than the compared limit. Accordingly, within one cycle of the presentation of the limit pairs from the limit registers 406A . . . F, the location of the suction pressure in relationship to one of the defined regions will be indicated on lines 416 and 418 and presented to a logic enable unit 420.

A level-change look-up table circuit 422 is connected to both the timing and control circuit 404 and the aforedescribed enable logic circuit 420. The level change look-up table 422, which may take the form of a read only memory (ROM), includes addressable registers that contain the level change information for each of the regions (e.g., region II, +2 level changes). As the timing and control circuit 404 enables successive limit-pair registers 406A . . . F it also addresses corresponding address locations in the level change table look-up table 422. When the region in which the suction pressure exists is identified through the enable logic circuit 420, the corresponding region level change in the associated address memory location is gated to an adder 424 which, also receives the present compressor information in binary form from a present level register 426. Thus, the adder 424 combines the required level change information with the actual present level information to provide a new level change request in 8-bit binary form. This information is presented to an 8/3 line selector 428 which enables one of three output lines in accordance with the level change request. An 8-bit dip switch register 433, a comparator 434, an AND gate 435, and a data selector 436, inhibits line selector 428 from selecting a capacity level below a selected minimum level INCH during a hot gas defrost in any one of the evaporators $E_1 \ldots E_n$. The hot gas defrost signal is received through AND gate 435. The output lines of the 8/3 line selector 428 are connected to one input of three AND gates 430a . . . c with the other input of each of these AND gates connected to a temperature signal input that carries the signal that at least one of the refrigerated spaces $S_1 \ldots S_n$ is above its upper temperature limit $T_u$. The output of the AND gates 430A . . . C are connected to respective driver amplifiers 432A . . . C which in turn provide 'COMSEL' signals to the various compressors A, B, and C.

The disclosed three compressor systems the microprocessor-based controller and its flow diagrams, and the discrete component controllers are exemplary of the present invention and, as can be readily appreciated other multiple-compressor configurations are possible. For instance, an exemplary four compressor arrangement having compressors A, B, C, and D of 15, 10, 7.5, and 5 horsepower would have fourteen available operating states as follows:

TABLE II

| CAPACITY STATE | % CAP. | A | B | C | D | HP |
|---|---|---|---|---|---|---|
| 0 | Zero | 0 | 0 | 0 | 0 | Zero |
| 1 | 13.3 | 0 | 0 | 0 | 1 | 5 |
| 2 | 20.0 | 0 | 0 | 1 | 0 | 7.5 |
| 3 | 26.6 | 0 | 1 | 0 | 0 | 10 |
| 4 | 33.3 | 0 | 0 | 1 | 1 | 12.5 |
| 5 | 40.0 | 1 | 0 | 0 | 0 | 15 |
| 6 | 46.6 | 0 | 1 | 1 | 0 | 17.5 |
| 7 | 53.3 | 1 | 0 | 0 | 1 | 20 |
| 8 | 60.0 | 1 | 0 | 1 | 0 | 22.5 |
| 9 | 66.6 | 1 | 1 | 0 | 0 | 25 |
| 10 | 73.3 | 1 | 0 | 1 | 0 | 27.5 |
| 11 | 80.0 | 1 | 1 | 0 | 1 | 30 |
| 12 | 86.6 | 1 | 1 | 1 | 0 | 32.5 |
| 13 | 100.0 | 1 | 1 | 1 | 1 | 37.5 |

As can be appreciated, were the above listed four compressor systems operated in accordance with prior suction pressure control systems, only compressor capacity states zero, 5, 9, 12, and 13 would be available.

In the compressor system configurations disclosed above, the compressors have had unequal compressor capacities. While this unequal-compressor-capacity is desirable in providing a relatively large number of operating states, the invention is also suitable in the context of multiple-compressors in which the compressors each have the same compressor capacity. The number of compressor capacity operating states is the same as with conventional controllers but it is nonetheless possible to simultaneously increment or decrement compressor capacity more than one level.

As will be apparent to those skilled in the art, various changes and modifications may be made to the present invention without departing from the spirit and scope of the invention as recited in the claims and their legal equivalent.

What is claimed is:

1. A multiple compressor refrigeration system for refrigerating spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence;

condenser means connected to said compressors for receiving a compressed working fluid therefrom;

expansion and evaporator means connected to said condenser means for receiving condensed working fluid therefrom for expansion and evaporation thereof thereby to effect refrigeration of said spaces, said expansion and evaporation means connected to the inlet of said compressors to provide the expanded working fluid thereto;

pressure-responsive means connected to said compressors for providing a signal output representative of the pressure of the working fluid on the inlet side of said compressors, said working fluid pressure representing the load requirements of said system and said pressure-representative signal representing a pressure value within one of a plurality of discrete zones of values each defined by a threshold pressure, said threshold pressures being sequentially and incrementally representative of deviations of system load from a preferred range of pressure values; and controller means connected to said pressure-responsive means for receiving said signal therefrom and connected to said compressors for effecting individual control of said compressors in response to said signal output, said controller means selecting any one of said compressor capacity operating states as a function of said pressure value within said discrete pressure zone and the compressor capacity operating state in effect when said pressure-representative signal is received, said controller means responding to said sensed pressure-representative signal in a step independent of any possible intermediate compressor capacity operating states, said step determined at least in part as a function of the rate of working fluid pressure rise or fall, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

2. A multiple compressor refrigeration system for refrigerating a plurality of discrete spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence, at least one of said compressors having a compressor capacity different from another;

condenser means connected to said compressors for receiving a compressed working fluid therefrom;

expansion and evaporator means connected to said condenser means for receiving condensed working fluid therefrom for expansion and evaporation thereof to effect refrigeration of said discrete spaces, said expansion and evaporation means connected to the inlet of said compressors to provide the expanded working fluid thereto;

pressure-responsive means connected to said compressors for providing a signal output representative of the pressure of the working fluid on the inlet side of said compressors, said signal output being representative of operating evaporator load for said system; and controller means connected to said pressure-responsive means for receiving said signal therefrom and connected to said compressors for effecting individual control of said compressors in response to said signal output, said controller means including means for comparing said measured inlet pressure with predetermined pressure limits for successively higher pressure ranges relative to a preferred pressure range and with predetermined pressure limits for successively lower pressure ranges relative to said predetermined pressure range, said controller independently selecting cumulatively greater compressor capacity states for each successive pressure-range increase and independently selecting cumulatively lower compressor states for each successive pressure-range decrease, said controller means responding to the difference between said measured inlet pressure and said preferred pressure-range in a step determined at least in part as a function of the operating state in effect when said pressure-representative signal is received and the rate of working fluid pressure rise or fall, said step independent of any possible intermediate compressor capacity operating states, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

3. A multiple compressor refrigeration system for refrigerating spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence;

condenser means connected to said compressors for receiving a compressed working fluid therefrom;

expansion and evaporator means connected to said condenser means for receiving condensed working fluid therefrom for expansion and evaporation thereof thereby to effect refrigeration of said spaces, said expansion and evaporation means connected to the inlet of said compressors to provide the expanded working fluid thereto;

pressure-responsive means connected to said compressors for providing a signal output representative of the pressure of the working fluid on the inlet side of said compressors, said working fluid pressure representing the load requirements of said system and said pressure-representative signal representing a pressure value within one of a plurality of discrete zones of values each defined by a threshold pressure, said threshold pressures being sequentially and incrementally representative of deviations of system load from a preferred range of pressure values; and controller means connected to said pressure-responsive means for receiving said signal therefrom and connected to said compressors for effecting individual control of said compressors in response to said signal output, said controller means selecting any one of said compressor capacity operating states as a function of said pressure valve within said discrete pressure zone and the compressor capacity operating state in effect when said pressure-representative signal is received, said controller means responding to said sensed pressure-representative signal in a step independent of any possible intermediate compressor capacity operating states, said step determined at least in part as a function of the rate of working fluid pressure rise or fall, said controller thus controlling compressor capacity in accordance with system load by determining which one of said compressor capacity operating states optimally meets said system load by providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors; and temperature responsive means thermally coupled to said evaporation means and said controller for sensing the temperature of at least one evaporator in said system and providing a temperature signal representative thereof, said controller responding to said temperature signal to inhibit otherwise determined increases in compressor capacity when said temperature of said sensed evaporator is below a predetermined value.

4. The multiple compressor refrigeration system claimed in claims 1, 2 or 3 wherein:

each of said compressors has a compressor capacity different from the others.

5. A method of operating a multiple compressor refrigeration system for refrigerating a space or a plurality of spaces of the type having a plurality of individually-operable compressors for compressing a working fluid, at least two of said compressors being connected in parallel and no two compressors being operable in a required fixed predetermined sequence, at least one of said compressors having a different compressor capacity from the others; a working fluid condenser connected to the outlet of said compressors for receiving compressed working fluid therefrom; working fluid expansion and evaporator means to cause expansion and evaporation of said compressed working fluid to effect refrigeration of said space or spaces thereby, said expansion and evaporator means connected to the inlet of said compressors to provide the expanded working fluid thereto from said expansion and evaporator means, pressure-responsive means connected to the inlet of said compressors for providing a measured-pressure signal, and controller means connected to said compressors for effecting operation thereof and connected to said pressure-responsive means for receiving said measured-pressure signal therefrom, said method comprising the steps of:

(a) measuring the working fluid pressure on the inlet side of said compressors as an indication of the evaporator load of the system;

(b) comparing said so-measured pressure with a preferred range of pressure values;

(c) selecting at least one of all of the available compressor operating states as a function of said comparison between said so-measured pressure and said preferred pressure range, the operating state in effect when said measured-pressure signal is received, and the rate of pressure rise or fall;

(d) implementing said selected compressor operating state by enabling selected ones of said plurality of compressors and disabling selected ones of said plurality of compressors;

(e) repeating steps (a) and (b) on a continuous basis to determine if said pressure is within said preferred pressure range; and (f) repeating steps (c) and (d) if it is determined that said pressure is not within said preferred pressure range.

6. The method claimed in claim 5 wherein:

each of said compressors has a different compressor capacity from the other.

7. The method claimed in claim 5 wherein:

said multiple compressor refrigeration system further comprises temperature-responsive means thermally coupled to said evaporator means and said method further comprises the step, after said selecting step and before said implementing step, of measuring said evaporator temperature and enabling said controller for operation when said so-measured temperature is greater than a preselected limit.

8. A controller for controlling a plurality of refrigeration compressors, at least two of which are connected in parallel, in a refrigeration system in which no two compressors are operable in a required fixed predetermined sequence and at least one of said compressors is of unequal refrigeration capacity relative to the others, said compressors being operable individually or in various combinations, said system thereby capable of achieving any one of a plurality of discrete compressor capacity operating states, said refrigeration system including pressure-responsive means for measuring the system suction pressure representative of system load, said suction pressure having a value within one of a plurality of discrete zones of values each defined by a threshold pressure, said threshold pressures being sequentially and incrementally representative of deviations of system load from a predetermined preferred range of pressure values, said controller including means for comparing said so-called suction pressure with said preferred range of pressure values, said controller responding to the difference between said sensed suction pressure and said preferred range by selecting any one of said compressor capacity operating states in a step determined at least in part as a function of the operating state in effect when said suction pressure is sensed and the rate of suction pressure rise or fall, said step independent of any possible intermediate compressor capacity operating states, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

9. The controller of claim 8 further including temperature sensing means for sensing temperatures of at least one of said refrigerated spaces and providing a temperature signal representative thereof, said controller responding to said temperature signal to inhibit otherwise determined increases in compressor capacity when said refrigerated space temperature is below a predetermined level.

10. The multiple compressor refrigeration system of claims 1 or 2 further including temperature sensing means for sensing temperature of at least one of said refrigerated spaces and providing a temperature signal representative thereof, said contoller responding to said temperature signal to inhibit otherwise determined increases in compressor capacity when said refrigerated space temperature is below a predetermined level.

11. A multiple compressor refrigeration system for refrigerating spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence;

condenser means connected to said compressors for receiving a compressed working fluid therefrom;

expansion and evaporator means connected to said condenser means for receiving condensed working fluid therefrom for expansion and evaporation thereof thereby to effect refrigeration of said spaces, said expansion and evaporation means connected to the inlet of said compressors to provide the expanded working fluid thereto;

pressure-responsive means connected to said compressors for providing a signal output representative of the pressure of the working fluid on the inlet side of said compressors, said working fluid pressure representing the load requirements of said system and said pressure-representative signal representing a pressure value within one of a plurality of discrete zones of values each defined by a threshold pressure, said threshold pressures being sequentially and incrementally representative of deviations of system load from a preferred range of pressure values; and microprocessor based controller means connected to said pressure-responsive means for receiving said signal therefrom and connected to said compressors for effecting individual control of said compressors in response to said signal output, said controller means selecting any one of said compressor capacity operating states as a function of said pressure value within said discrete pressure zone and the compressor capacity operating state in effect when said pressure-representative signal is received, said controller means responding to said sensed pressure-representative signal in a step independent of any possible intermediate compressor capacity operating states, said step determined at least in part as a function of the rate of working fluid pressure rise or fall, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

12. A multiple compressor refrigeration system for refrigerating a plurality of discrete spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence, at least one of said compressors having a compressor capacity different from another;

condenser means connected to said compressors for receiving a compressed working fluid therefrom;

expansion and evaporator means connected to said condenser means for receiving condensed working fluid therefrom for expansion and evaporation thereof to effect refrigeration of said discrete spaces, said expansion and evaporation means connected to the inlet of said compressors to provide the expanded working fluid thereto;

pressure-responsive means connected to said compressors for providing a signal ouput representative of the pressure of the working fluid on the inlet side of said compressors, said signal output being representative of operating evaporator load for said system; and microprocessor based controller means connected to said pressure-responsive means for receiving said signal therefrom and connected to said compressors for effecting individual control of said compressors in response to said signal output, said controller means including means for comparing said measured inlet pressure with predetermined pressure limits for successively higher pressure ranges relative to a preferred pressure range and with predetermined pressure limits for successively lower pressure ranges relative to said preferred pressure range, said controller independently selecting cumulatively greater compressor capacity states for each successive pressure-range increase and independently selecting cumulatively lower compressor states for each successive pressure-range decrease, said controller means responding to the difference between said measured inlet pressure and said preferred pressure-range in a step determined at least in part as a function of the operating state in effect when said pressure-representative signal is received and the rate of working fluid pressure rise or fall, said step independent of any possible intermediate compressor capacity operating states, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

13. A multiple compressor refrigeration system for refrigerating spaces, comprising:

a plurality of compressors, each having an inlet and an outlet, said compressors being operable individually or in various combinations, said system thereby capable of achieving any one of a plurality of discrete compressor capacity operating states, at least two of said compressors being connected in parallel and no two compressors being operable in a required fixed predetermined sequence;

condenser means connected to said compressors for receiving a compressed working fluid therefrom;

expansion and evaporator means connected to said condenser means for receiving condensed working fluid therefrom for expansion and evaporation thereof thereby to effect refrigeration of said spaces, said expansion and evaporation means connected to the inlet of said compressors to provide the expanded working fluid thereto;

pressure-responsive means connected to said compressors for providing a signal output representative of the pressure of the working fluid on the inlet side of said compressors, said working fluid pressure representing the load requirements of said system and said pressure-representative signal representing a pressure value within one of a plurality of discrete zones of values each defined by a threshold pressure, said threshold pressures being sequentially and incrementally representative of deviations of system load from a preferred range of pressure values; and microprocessor based controller means connected to said pressure-responsive means for receiving said signal therefrom and connected to said compressors for effecting individual control of said compressors in response to said signal output, said controller means selecting any one of said compressor capacity operating states as a function of said pressure valve within said discrete pressure zone and the compressor capacity operating state in effect when said pressure-representative signal is received, said controller means responding to said sensed pressure-representative signal in a step independent of any possible intermediate compressor capacity operating states, said step determined at least in part as a function of the rate of working fluid pressure rise or fall, said controller thus controlling compressor capacity in accordance with system load by determining which one of said compressor capacity operating states optimally meets said system load by providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors; and temperature responsive means thermally coupled to said evaporation means and said controller for sensing the temperature of at least one evaporator in said system and providing a temperature signal representative thereof, said controller responding to said temperature signal to inhibit otherwise determined increases in compressor capacity when said temperature of said sensed evaporator is below a predetermined value.

14. The multiple compressor refrigeration system claimed in claims 11, 12 or 13 wherein:

each of said compressors has a compressor capacity different from the others.

15. A method of operating a multiple compressor refrigeration system for refrigerating a space or a plurality of spaces of the type having a plurality of individually-operable compressors for compressing a working fluid, at least two of said compressors being connected in parallel and no two compressors being operable in a required fixed predetermined sequence, at least one of said compressors having a different compressor capacity from the others; a working fluid condenser connected to the outlet of said compressors for receiving compressed working fluid therefrom; working fluid expansion and evaporator means to cause expansion and evaporation of said compressed working fluid to effect refrigeration of said space or spaces thereby, said expansion and evaporator means connected to the inlet of said compressors to provide the expanded working fluid thereto from said expansion and evaporator means, pressure-responsive means connected to the inlet of said compressors for providing a measured-pressure signal, and microprocessor based controller means connected to said compressors for effecting operation thereof and connected to said pressure-responsive means for receiving said measured-pressure signal therefrom, said method comprising the steps of:

(a) measuring the working fluid pressure on the inlet side of said compressors as an indication of the evaporator load of the system;

(b) comparing said so-measured pressure with a preferred range of pressure values;

(c) selecting at least one of all of the available compressor operating states as a function of said comparison between said so-measured pressure and said preferred pressure range, the operating state in effect when said measured-pressure signal is received, and the rate of pressure rise or fall;

(d) implementing said selected compressor operating state by enabling selected ones of said plurality of compressors and disabling selected ones of said plurality of compressors;

(e) repeating steps (a) and (b) on a continuous basis to determine if said pressure is within said preferred pressure range; and (f) repeating steps (c) and (d) if it is determined that said pressure is not within said preferred pressure range.

16. The method claimed in claim 15 wherein:

each of said compressors has a different compressor capacity from the other.

17. The method claimed in claim 15 wherein:

said multiple compressor refrigeration system further comprises temperature-responsive means thermally coupled to said evaporator means and said method further comprises the step, after said selecting step and before said implementing step, of measuring said evaporator temperature and enabling said controller for operation when said so-measured temperature is greater than a preselected limit.

18. A microprocessor based controller for controlling a plurality of refrigeration compressors, at least two of which are connected in parallel, in a refrigeration system in which no two compressors are operable in a required fixed predetermined sequence and at least one of said compressors is of unequal refrigeration capacity relative to the others, said compressors being operable individually or in various combinations, said system thereby capable of achieving any one of a plurality of discrete compressor capacity operating states, said refrigeration system including pressure-responsive means for measuring the system suction pressure representative of system load, said suction pressure having a value within one of a plurality of discrete zones of values each defined by a threshold pressure, said threshold pressures being sequentially and incrementally representative of deviations of system load from a predetermined preferred range of pressure values, said controller including means for comparing said so-called suction pressure with said preferred range of pressure values, said controller responding to the difference between said sensed suction pressure and said preferred range by selecting any one of said compressor capacity operating states in a step determined at least in part as a function of the operating state in effect when said suction pressure is sensed and the rate of suction pressure rise or fall, said step independent of any possible intermediate compressor capacity operating states, said controller thus controlling compressor capacity in accordance with system load by determining which one of said compressor capacity operating states optimally meets said system load and providing a signal for turning on or off selected ones of said plurality of compressors, thereby to provide compressor capacity to said system responsive to said load requirements without predeterminably enabling a selected one of said compressors in an ordered and predetermined sequence prior to enabling a required another one of said compressors.

19. The microprocessor based controller of claim 18 further including temperature sensing means for sensing temperatures of at least one of said refrigerated spaces and providing a temperature signal representative thereof, said controller responding to said temperature signal to inhibit otherwise determined increases in compressor capacity when said refrigerated space temperature is below a predetermined level.

20. The multiple compressor refrigeration system of claims 11 or 12 further including temperature sensing means for sensing temperature of at least one of said refrigerated spaces and providing a temperature signal representative thereof, said contoller responding to said temperature signal to inhibit otherwise determined increases in compressor capacity when said refrigerated space temperature is below a predetermined level.

* * * * *